US009696046B2

(12) United States Patent
Stewart et al.

(10) Patent No.: US 9,696,046 B2
(45) Date of Patent: Jul. 4, 2017

(54) MODULAR AIR HANDLING UNIT

(75) Inventors: Jeffrey L. Stewart, Whitehouse, TX (US); Mark Hudgins, Whitehouse, TX (US); Richard Lee Jameson, Tyler, TX (US); Keith Adam Novak, Holmen, WI (US); Leslie Zinger, Frankston, TX (US)

(73) Assignee: Trane International Inc., Piscataway, NJ (US)

( * ) Notice: Subject to any disclaimer, the term of this patent is extended or adjusted under 35 U.S.C. 154(b) by 764 days.

(21) Appl. No.: 12/732,777

(22) Filed: Mar. 26, 2010

(65) Prior Publication Data

US 2011/0237177 A1 Sep. 29, 2011

(51) Int. Cl.

| | |
|---|---|
| ***H05K 7/20*** | (2006.01) |
| ***F24F 3/044*** | (2006.01) |
| ***F24F 13/20*** | (2006.01) |

(52) U.S. Cl.

CPC ..... *F24F 3/0442* (2013.01); *F24F 13/20* (2013.01)

(58) Field of Classification Search

CPC ..... H05K 7/20; H95K 7/20
USPC ..... 454/184; 361/687
See application file for complete search history.

(56) References Cited

U.S. PATENT DOCUMENTS

| | | | | |
|---|---|---|---|---|
| 1,796,828 | A | | 3/1931 | Clingman |
| 2,789,024 | A | | 4/1957 | Heisler |
| 3,212,285 | A | | 10/1965 | Wilson |
| 3,623,335 | A | | 11/1971 | Shanner |
| 3,836,221 | A | * | 9/1974 | Whistler et al. ..... 312/237 |
| 4,342,439 | A | * | 8/1982 | Bruner ..... 248/544 |
| 4,415,019 | A | | 11/1983 | Hunzicker |
| 4,723,419 | A | | 2/1988 | Kessler et al. |

(Continued)

FOREIGN PATENT DOCUMENTS

| | | |
|---|---|---|
| CN | 2226126 A | 5/1996 |
| CN | 2226126 Y | 5/1996 |

(Continued)

OTHER PUBLICATIONS

Lackie, Scott A., et al.; U.S. Appl. No. 12/732,762, filed Mar. 26, 2010; "Air Handling Unit With Inner Wall Space."

(Continued)

*Primary Examiner* — Steven B McAllister
*Assistant Examiner* — Samantha Miller
(74) *Attorney, Agent, or Firm* — Conley Rose, P.C.; J. Robert Brown, Jr.; Michael J. Schofield

(57) ABSTRACT

An air handling unit has a first modular cabinet comprising a first profile, a second modular cabinet comprising a second profile that is complementary to the first profile, and the first profile comprises an alignment feature. An air handling unit has a heat exchanger cabinet comprising a first profile, a blower cabinet comprising a second profile complementary to the first profile, a first connector system disposed at least partially on each of the heat exchanger cabinet and the blower cabinet, and the first connector system is operable to releasably secure the first profile to the second profile. An air handling unit has a first modular cabinet comprising a first portion of a first connection system and a second modular cabinet comprising a second portion of the first connection system. A component of the first portion may be least partially received within the second portion.

20 Claims, 10 Drawing Sheets

(56) References Cited

U.S. PATENT DOCUMENTS

| | | | | |
|---|---|---|---|---|
| 4,825,847 | A | 5/1989 | Perron | |
| 4,972,298 | A | 11/1990 | Casa et al. | |
| 5,160,481 | A | 11/1992 | Weaver | |
| 5,170,550 | A | 12/1992 | Cox et al. | |
| 5,255,969 | A * | 10/1993 | Cox et al. | 312/236 |
| 5,277,036 | A | 1/1994 | Dieckmann et al. | |
| 5,396,782 | A | 3/1995 | Ley et al. | |
| 5,450,285 | A | 9/1995 | Schlemmer | |
| 5,485,954 | A | 1/1996 | Guy et al. | |
| 5,517,387 | A | 5/1996 | Smith | |
| 5,582,026 | A | 12/1996 | Barto, Sr. | |
| 5,622,058 | A | 4/1997 | Ramakrishnan et al. | |
| 5,825,847 | A | 10/1998 | Ruth et al. | |
| 5,897,181 | A * | 4/1999 | Avendano et al. | 312/401 |
| 5,947,573 | A * | 9/1999 | Tovar et al. | 312/404 |
| 5,992,960 | A * | 11/1999 | Wolanin | 312/407 |
| 6,053,591 | A * | 4/2000 | Kasanic | 312/297 |
| 6,088,225 | A | 7/2000 | Parry et al. | |
| 6,109,712 | A * | 8/2000 | Haworth et al. | 312/400 |
| 6,658,904 | B2 | 12/2003 | Herbeck et al. | |
| 6,676,234 | B2 | 1/2004 | Herbeck et al. | |
| 6,781,831 | B1 | 8/2004 | Banton et al. | |
| 6,788,544 | B1 | 9/2004 | Barsun et al. | |
| 6,807,056 | B2 | 10/2004 | Kondo et al. | |
| 6,879,486 | B1 | 4/2005 | Banton et al. | |
| 6,974,383 | B2 | 12/2005 | Lewis et al. | |
| 6,987,673 | B1 | 1/2006 | French et al. | |
| 7,108,478 | B2 | 9/2006 | Hancock | |
| 7,187,547 | B1 | 3/2007 | French et al. | |
| 7,286,356 | B2 | 10/2007 | Keenan et al. | |
| 7,489,509 | B2 | 2/2009 | Keenan et al. | |
| 7,598,461 | B2 | 10/2009 | Kitamura et al. | |
| 7,643,285 | B2 * | 1/2010 | Nishiyama et al. | 361/679.49 |
| 7,857,402 | B2 * | 12/2010 | Anikhindi et al. | 312/319.4 |
| 7,914,366 | B2 | 3/2011 | Miyamoto et al. | |
| 8,070,242 | B2 | 12/2011 | Makabe | |
| 8,072,752 | B2 | 12/2011 | Wantschik | |
| 8,300,410 | B2 | 10/2012 | Slessman | |
| 8,717,747 | B2 | 5/2014 | Chen et al. | |
| 2002/0101117 | A1 | 8/2002 | Shibuya | |
| 2005/0086966 | A1 | 4/2005 | Bae | |
| 2005/0135059 | A1 | 6/2005 | Araki et al. | |
| 2005/0168929 | A1 | 8/2005 | Inoue et al. | |
| 2005/0231915 | A1 * | 10/2005 | Keenan et al. | 361/700 |
| 2005/0270751 | A1 | 12/2005 | Coglitore et al. | |
| 2006/0087801 | A1 | 4/2006 | Champion et al. | |
| 2006/0255700 | A1 * | 11/2006 | Park et al. | 312/228 |
| 2007/0053162 | A1 | 3/2007 | Keenan et al. | |
| 2007/0129000 | A1 | 6/2007 | Rasmussen et al. | |
| 2007/0213000 | A1 | 9/2007 | Day | |
| 2007/0257487 | A1 * | 11/2007 | Jacklich et al. | 285/401 |
| 2008/0086994 | A1 | 4/2008 | Descotes et al. | |
| 2009/0016009 | A1 | 1/2009 | Barrall et al. | |
| 2009/0071746 | A1 | 3/2009 | Teisseyre | |
| 2009/0071963 | A1 * | 3/2009 | Johnson et al. | 220/476 |
| 2009/0305621 | A1 * | 12/2009 | Eckardt et al. | 454/63 |
| 2010/0253196 | A1 * | 10/2010 | Nye | 312/352 |
| 2011/0056651 | A1 | 3/2011 | Monk et al. | |
| 2014/0213172 | A1 | 7/2014 | Jameson et al. | |
| 2015/0111488 | A1 | 4/2015 | Son et al. | |

FOREIGN PATENT DOCUMENTS

| | | | |
|---|---|---|---|
| CN | 1690534 | A | 11/2005 |
| CN | 2811822 | Y | 8/2006 |
| CN | 1888585 | A | 1/2007 |
| CN | 1979015 | A | 6/2007 |
| CN | 101440979 | A | 5/2009 |
| CN | 201297715 | Y | 8/2009 |
| CN | 201340028 | Y | 11/2009 |
| KR | 100781267 | B1 | 11/2007 |
| KR | 100851500 | B1 | 8/2008 |
| WO | 9424493 | | 10/1994 |
| WO | 9913273 | A1 | 3/1999 |
| WO | 0150067 | A2 | 7/2001 |
| WO | 2009137215 | A2 | 11/2009 |

OTHER PUBLICATIONS

Stewart, Jeffrey L., et al.; U.S. Appl. No. 12/732,772, filed Mar. 26, 2010; "Air Handling Unit With Inner Wall Features."

Chinese Office Action; Application No. 201110081227.X; dated Sep. 6, 2013; 9 pages.

Chinese Office Action; Application No. 201110081227.X; dated Mar. 25, 2013; 18 pages.

Office Action dated Mar. 27, 2013; U.S. Appl. No. 12/732,762, filed Mar. 26, 2010; 15 pages.

Office Action dated Apr. 10, 2013; U.S. Appl. No. 12/732,772, filed Mar. 26, 2010; 16 pages.

Canadian Office Action; Application No. 2,733,052; dated Mar. 8, 2013; 2 pages.

Chinese Office Action; Application No. 201110081439.8; dated Feb. 17, 2013; 11 pages.

Canadian Office Action; Application No. 2,733,051; dated Mar. 19, 2013; 2 pages.

Final Office Action dated Nov. 5, 2013; U.S. Appl. No. 12/732,762, filed Mar. 26, 2010; 22 pages.

Final Office Action dated Oct. 25, 2013; U.S. Appl. No. 12/732,772, filed Mar. 26, 2010; 9 pages.

Canadian Office Action; Application No. 2,733,052; dated Nov. 15, 2013; 2 pages.

Chinese Office Action; Application No. 201110081439.8; dated Sep. 22, 2013; 11 pages.

Canadian Office Action; Application No. 2,733,051; dated Nov. 15, 2013; 2 pages.

Chinese Office Action; Application No. 201110081227.X; dated Jan. 13, 2014; 29 pages.

Chinese Office Action; Application No. 201110081439.8; dated Apr. 15, 2014; 38 pages.

Chinese Office Action; Application No. 201110081227.X; dated May 14, 2014; 30 pages.

Chinese Office Action; Application No. 201110081439.8; dated Jul. 3, 2014; 14 pages.

Canadian Office Action; Application No. 2,733,052; dated Sep. 5, 2014; 2 pages.

Chinese Office Action; Application No. 201110081227.X; dated Oct. 8, 2014; 7 pages.

Chinese Office Action; Application No. 201110081439.8; dated Jan. 15, 2015; 10 pages.

Advisory Action dated Jan. 15, 2014; U.S. Appl. No. 12/732,762, filed Mar. 26, 2010; 3 pages.

Office Action dated Oct. 8, 2014; U.S. Appl. No. 12/732,762, filed Mar. 26, 2010; 31 pages.

Final Office Action dated May 11, 2015; U.S. Appl. No. 12/732,762, filed Mar. 26, 2010; 25 pages.

Advisory Action dated Feb. 12, 2014; U.S. Appl. No. 12/732,772, filed Mar. 26, 2010; 3 pages.

Office Action dated Oct. 8, 2014; U.S. Appl. No. 12/732,772, filed Mar. 26, 2010; 27 pages.

Final Office Action dated May 21, 2015; U.S. Appl. No. 12/732,772, filed Mar. 26, 2010; 28 pages.

Advisory Action dated Aug. 26, 2015; U.S. Appl. No. 12/732,762, filed Mar. 26, 2010; 7 pages.

Advisory Action dated Aug. 14, 2015; U.S. Appl. No. 12/732,772, filed Mar. 26, 2010; 7 pages.

Advisory Action dated Nov. 13, 2015; U.S. Appl. No. 12/732,762, filed Mar. 26, 2010; 3 pages.

Office Action dated Dec. 18, 2015; U.S. Appl. No. 12/732,762, filed Mar. 26, 2010; 13 pages.

Advisory Action dated Oct. 27, 2015; U.S. Appl. No. 12/732,772, filed Mar. 26, 2010; 4 pages.

Office Action dated Jan. 4, 2016; U.S. Appl. No. 12/732,772, filed Mar. 26, 2010; 15 pages.

Advisory Action dated Aug. 26, 2016; U.S. Appl. No. 12/732,762, filed Mar. 26, 2010; 4 pages.

(56) References Cited

OTHER PUBLICATIONS

Office Action dated Oct. 21, 2016; U.S. Appl. No. 12/732,762, filed Mar. 26, 2010; 13 pages.
Office Action dated Oct. 11, 2016; U.S. Appl. No. 12/732,772, filed Mar. 26, 2010; 11 pages.
Final Office Action dated Feb. 10, 2017; U.S. Appl. No. 12/732,762, filed Mar. 26, 2010; 19 pages.
Final Office Action dated Feb. 10, 2017; U.S. Appl. No. 12/732,772, filed Mar. 26, 2010; 10 pages.
Indian Office Action; Application No. 277/KOL/2011; Dec. 26, 2016; 8 pages.
Indian Office Action; Application No. 278/KOL/2011; Jan. 3, 2017; 8 pages.
Final Office Action dated May 20, 2016; U.S. Appl. No. 12/732,762, filed Mar. 26, 2010; 9 pages.
Advisory Action dated Jun. 16, 2016; U.S. Appl. No. 12/732,762, filed Mar. 26, 2010; 3 pages.
Final Office Action dated May 19, 2016; U.S. Appl. No. 12/732,772, filed Mar. 26, 2010; 19 pages.
Advisory Action dated Jun. 16, 2016; U.S. Appl. No. 12/732,772, filed Mar. 26, 2010; 3 pages.
Advisory Action dated Jul. 14, 2016; U.S. Appl. No. 12/732,772, filed Mar. 26, 2010; 4 pages.

* cited by examiner

MODULAR AIR HANDLING UNIT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise air handling units. Air handling units sometimes comprise blower assemblies for forcing air over refrigeration coil assemblies and/or heater assemblies in order to condition the air.

SUMMARY OF THE DISCLOSURE

In some embodiments, an air handling unit is provided that comprises a first modular cabinet comprising a first profile and a second modular cabinet comprising a second profile that is complementary to the first profile. The first profile comprises an alignment feature. In some embodiments, the first modular cabinet may be configured to carry a refrigeration coil assembly and the second modular cabinet may be configured to carry a blower assembly. In another embodiment, at least a portion of at least one of the first profile and the second profile may comprise a tray joined to at least one of the first profile and the second profile. In another embodiment, the tray may be connected to at least one of an inner cabinet shell and an outer cabinet skin. In another embodiment, at least one of the first modular cabinet and the second modular cabinet may comprise a gasket recess configured to receive a gasket between the first modular cabinet and the second modular cabinet.

In other embodiments, an air handling unit is provided that comprises a heat exchanger cabinet comprising a first profile, a blower cabinet comprising a second profile complementary to the first profile, a first connector system disposed at least partially on each of the heat exchanger cabinet and the blower cabinet, and the first connector system is operable to releasably secure the first profile to the second profile. In some embodiments, a second connector system may be substantially similar to the first connector system.

In other embodiments, an air handling unit is provided that comprises a first modular cabinet comprising a first portion of a first connection system and a second modular cabinet comprising a second portion of the first connection system. The first connection system is configured to selectively secure the first modular cabinet to the second modular cabinet in response to a component of the first portion being at least partially received within the second portion. In some embodiments, at least one connection system may be associated with a first side of the air handling unit and at least one connection system may be associated with a second side of the air handling unit, the second side being substantially opposite the first side. In some embodiments, the connection system may be accessible for selective actuation from an exterior of the air handling unit. In some embodiments, the connection system may be accessible for selective actuation from an interior of the air handling unit.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Conventional air handling units are sometimes too large for passage through small access openings, such as attic entrances. Accordingly, it is common for an installer to partially disassemble the air handling unit into components, pass those components through the small access opening, and thereafter reassemble the air handling unit. The process of disassembly and reassembly of the air handling unit may be difficult and time consuming. In particular, the locking together and separation of the components of the air handling unit may require the manipulation of many fasteners that are not amenable to convenient removal and/or application. Still further, when attempting to reassemble the components of the air handling unit, properly aligning the components may be difficult.

Some air handling units are configured for disassembly into a plurality of cabinet components. However, disassembly and subsequent reassembly of the cabinet components of current systems is difficult due in part due to a need to carefully align the cabinet components and in part due to the inconvenient methods of fastening the cabinet components together. Accordingly, the present system provides, among other features, an air handling unit (AHU) that comprises a plurality of cabinet components that may be easily joined and separated using convenient connection systems and with an increased ease of alignment between the cabinet components. The AHU of the present disclosure may be provided with cabinet components having complementary mating geometries that assist in aligning the cabinet components. The AHU of the present disclosure may also be provided with convenient quick-connect latches for quickly securing and/or releasing the cabinet components relative to each other.

Figure 1:
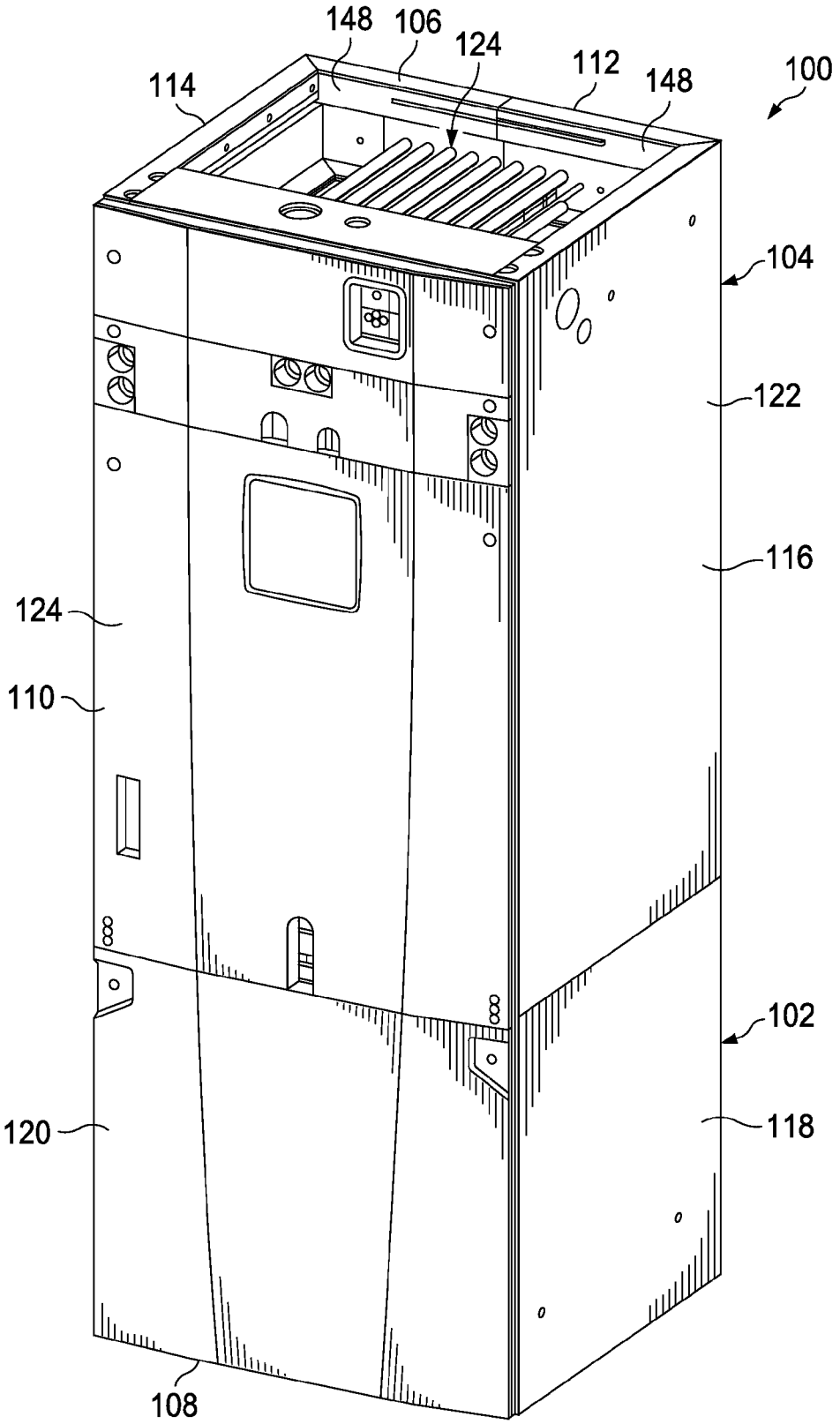
FIG. 1 is an oblique view of an air handling unit according to embodiments of the disclosure.
Figure 2:
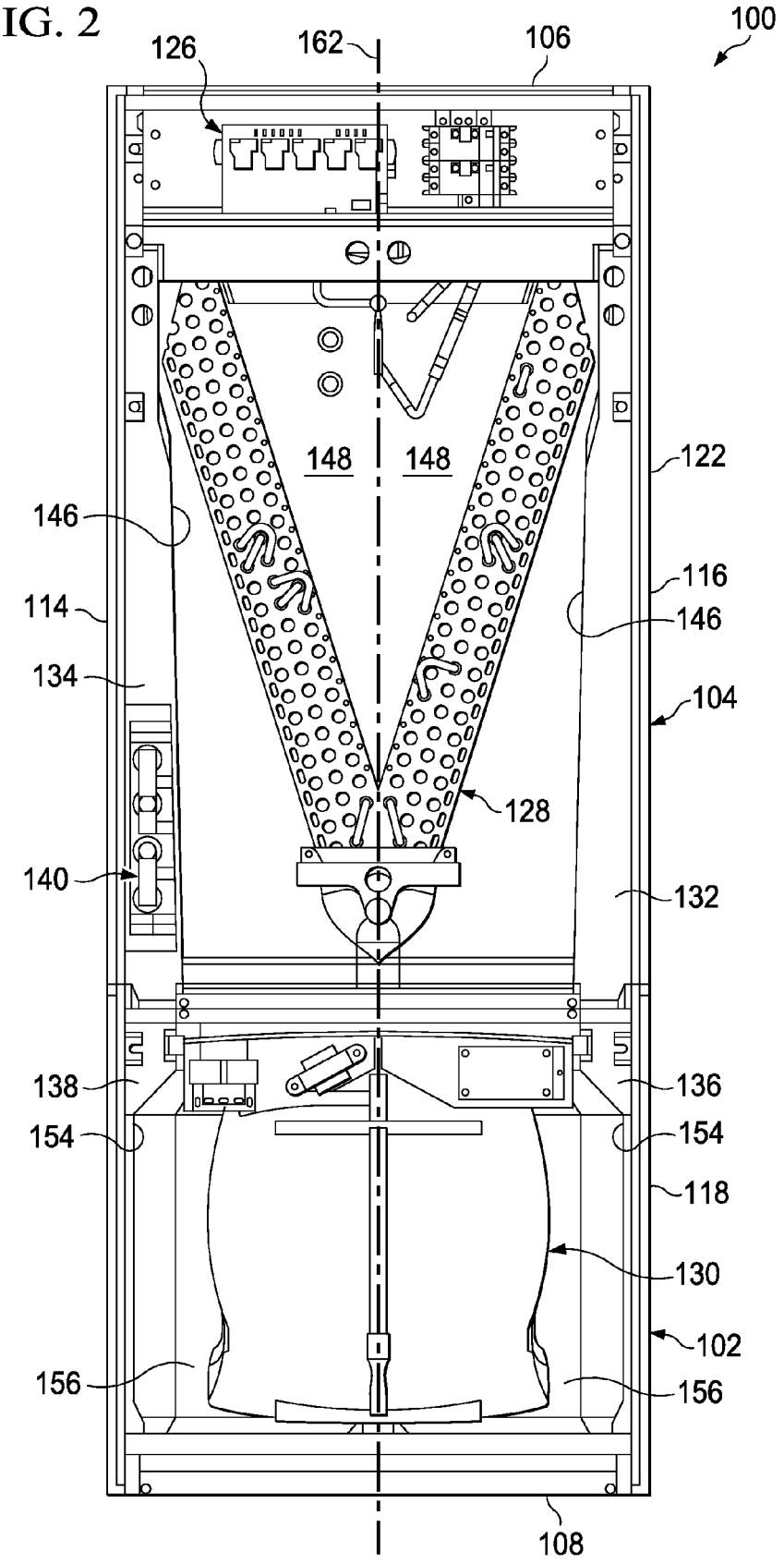
FIG. 2 is an orthogonal view of the front of the air handling unit of FIG. 1 in an assembled configuration.
Figure 3:
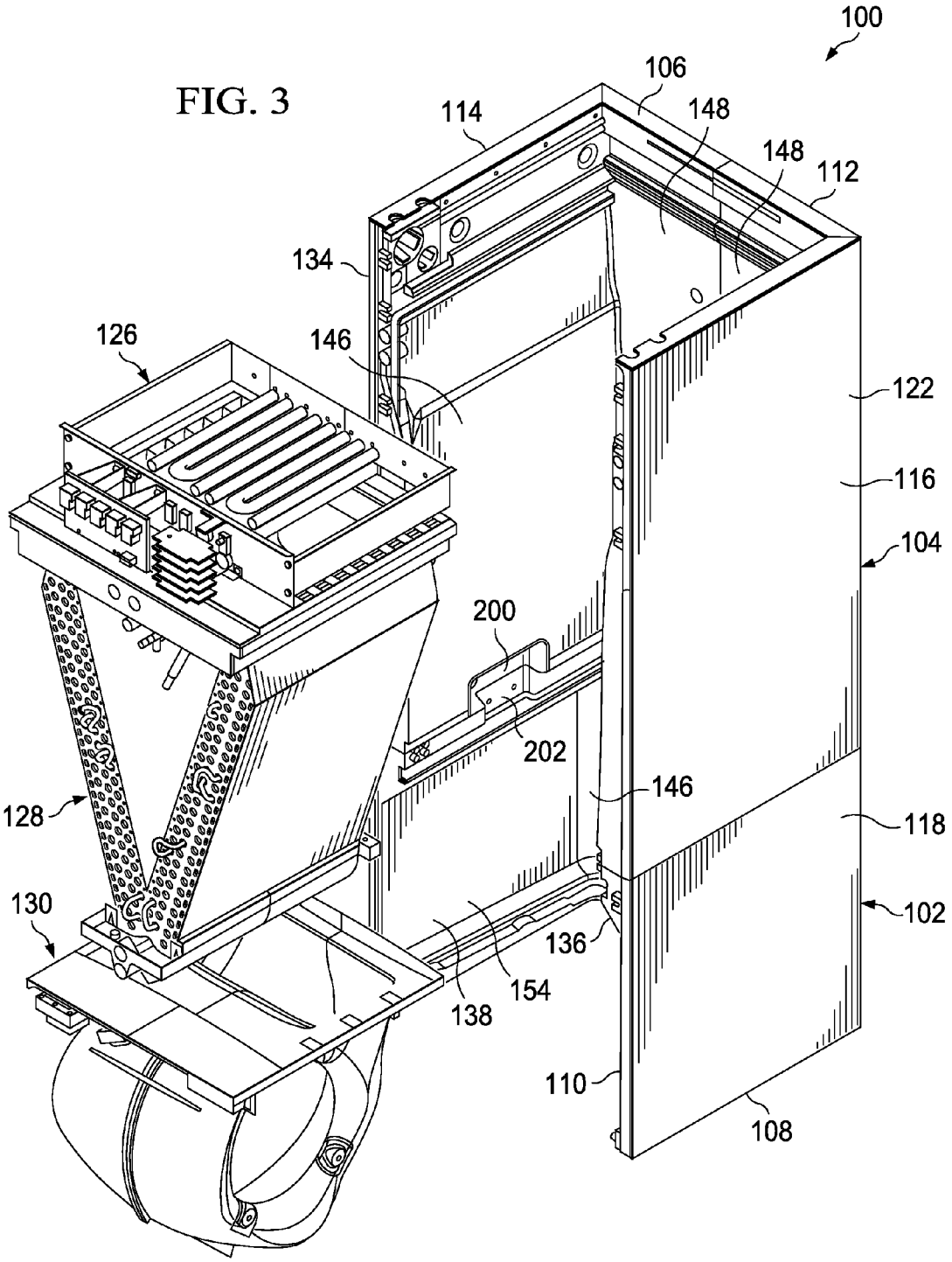
FIG. 3 is a partially exploded oblique view of the air handling unit of FIG. 1.

Referring now to FIGS. 1-3, an AHU 100 according to the disclosure is shown. In this embodiment, AHU 100 comprises a lower blower cabinet 102 attached to an upper heat exchanger cabinet 104. Most generally and for purposes of this discussion, AHU 100 may be described as comprising a top side 106, a bottom side 108, a front side 110, a back side 112, a left side 114, and a right side 116. Such directional descriptions are meant to assist the reader in understanding the physical orientation of the various components parts of the AHU 100, however, such directional descriptions shall not be interpreted as limitations to the possible installation orientations of an AHU 100. Further, the above-listed directional descriptions may be shown and/or labeled in the figures by attachment to various component parts of the AHU 100. Attachment of directional descriptions at different locations or two different components of AHU 100 shall not be interpreted as indicating absolute locations of directional limits of the AHU 100. Instead, a plurality of shown and/or labeled directional descriptions in a single figure shall provide general directional orientation to the reader so that directionality may be easily followed amongst the various figures. Still further, the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

Blower cabinet 102 comprises a four-walled fluid duct that accepts fluid (air) in through an open bottom side of the blower cabinet 102 and allows exit of fluid through an open top side of the blower cabinet 102. In this embodiment, the exterior of the blower cabinet 102 comprises a blower cabinet outer skin 118 and a blower cabinet panel 120. The blower cabinet panel 120 is removable from the remainder of the blower cabinet 102 thereby allowing access to an interior of the blower cabinet 102. Similarly, heat exchanger cabinet 104 comprises a four-walled fluid duct that accepts fluid (air) from the blower cabinet 102 and passes the fluid from an open bottom side of the heat exchanger cabinet 104 and allows exit of the fluid through an open top side of the heat exchanger cabinet 104. In this embodiment, the exterior of the heat exchanger cabinet 104 comprises a heat exchanger cabinet outer skin 122 and a heat exchanger cabinet panel 124. The heat exchanger cabinet panel 124 is removable from the remainder of the heat exchanger cabinet 104 thereby allowing access to an interior of the heat exchanger cabinet 104.

The AHU 100 further comprises a plurality of selectively removable components. More specifically, the AHU 100 comprises a heater assembly 126 and may be removably carried within the heat exchanger cabinet 104. The AHU 100 further comprises a refrigeration coil assembly 128 that may also be removably carried within the heat exchanger cabinet 104. In this embodiment, the heater assembly 126 is configured to be optionally carried within heat exchanger cabinet 104 nearer the top side 106 of the AHU 100 than the refrigeration coil assembly 128. Similarly, the AHU 100 comprises a blower assembly 130 that may be removably carried within the blower cabinet 102. The AHU 100 may be considered fully assembled when the blower assembly 130 is carried within the blower cabinet 102, each of the refrigeration coil assembly 128 and the heater assembly 126 are carried within the heat exchanger cabinet 104, and when the blower cabinet panel 120 and heat exchanger cabinet panel 124 are suitably associated with the blower cabinet outer skin 118 and the heat exchanger cabinet outer skin 122, respectively. When the AHU 100 is fully assembled, fluid (air) may generally follow a path through the AHU 100 along which the fluid enters through the bottom side 108 of the AHU 100, successively encounters the blower assembly 130, the refrigeration coil assembly 128, and the heater assembly 126, and thereafter exits the AHU 100 through the top side 106 of the AHU 100.

In this embodiment, each of the four walls of the blower cabinet 102 and the heat exchanger cabinet 104 are configured to have a double-wall construction. More specifically, the heat exchanger cabinet 104 further comprises a heat exchanger cabinet right shell 132 and a heat exchanger cabinet left shell 134. In this embodiment, the heat exchanger cabinet right shell 132 and the heat exchanger cabinet left shell 134 may be joined to generally form the interior of the heat exchanger cabinet 104. In order to form the above-mentioned double-wall construction for the heat exchanger cabinet 104, the heat exchanger cabinet outer skin 122 generally covers the right side and back side of the heat exchanger right shell 132 while also generally covering the left side and back side of the heat exchanger left shell 134. Most generally, the heat exchanger cabinet right shell 132, the heat exchanger cabinet left shell 134, and the heat exchanger cabinet outer skin 122 are shaped so that upon their assembly together a heat exchanger cabinet wall space 142 exists between the heat exchanger cabinet outer skin 122 and each of the heat exchanger cabinet right shell 132 and the heat exchanger cabinet left shell 134. The blower cabinet right shell 136, the blower cabinet left shell 138, and the blower cabinet outer skin 118 are also shaped so that upon their assembly together a blower cabinet wall space 144 exists between the blower cabinet outer skin 118 and each of the blower cabinet right shell 136 and the blower cabinet left shell 138.

In some embodiments, one or more of the heat exchanger cabinet wall space 142 and blower cabinet wall space 144 may be at least partially filled with an insulating material. More specifically, in some embodiments, a polyurethane foam may at least partially fill exchanger cabinet wall space 142 and the lower cabinet wall space 144. At least partially filling one or more of the spaces 142, 144 may increase a structural integrity of the AHU 100, may increase a thermal resistance of the AHU 100 between the interior of the AHU 100 and the exterior of the AHU 100, may decrease air leakage from the AHU 100, and may reduce and/or eliminate the introduction of volatile organic compounds (VOCs) into breathing air attributable to the AHU 100. Such a reduction in VOC emission by the AHU 100 may be attributable to the lack of and/or reduced use of traditional fiberglass insulation within the AHU 100 made possible by the insulative properties provided by the polyurethane foam within the spaces 142, 144.

In some embodiments, each of the blower cabinet outer skin 118 and the heat exchanger cabinet outer skin 122 may be constructed of metal and/or plastic and/or other suitable materials. Each of the heat exchanger cabinet right shell 132, the exchanger cabinet left shell 134, lower cabinet right shell 136, and blower cabinet left shell 138 may be constructed of a sheet molding compound (SMC). The SMC may be chosen for its ability to the primary requirements of equipment and/or safety certification organizations and/or its relatively rigid cleanable surfaces that are resistant to mold growth and compatible with the use of antimicrobial cleaners. Further, the polyurethane foam used to fill the spaces 142, 144 may comprise a blowing agent such as refrigerant to enhance the thermal insulating characteristics of the foam. Of course, in alternative embodiments, any other suitable material may be used to form the components of the AHU 100.

Further, each of the heat exchanger cabinet right shell 132 and the heat exchanger cabinet left shell 134 comprise an interior side surface 146, an interior rear surface 148, an exterior site surface, and an exterior rear surface. Similarly, each of the blower cabinet right shell 136 and the blower cabinet left shell 138 comprise an interior side surface 154, an interior rear surface 156, an exterior side surface, and an exterior rear surface. Most generally, and with a few exceptions, it will be appreciated that each of the pairs of interior side surfaces 146, interior rear surfaces 148, exterior side surfaces, exterior rear surfaces, interior side surfaces 154, interior rear surfaces 156, exterior side surfaces, and exterior rear surfaces are substantially mirror images of each other. More specifically, the above listed pairs of surfaces are substantially mirror images of each other about a bisection plane 162 (see FIG. 2) that is generally parallel to both the AHU left side 114 and the AHU right side 116 and which is substantially equidistant from both the AHU left side 114 and the AHU right side 116.

Figure 4:
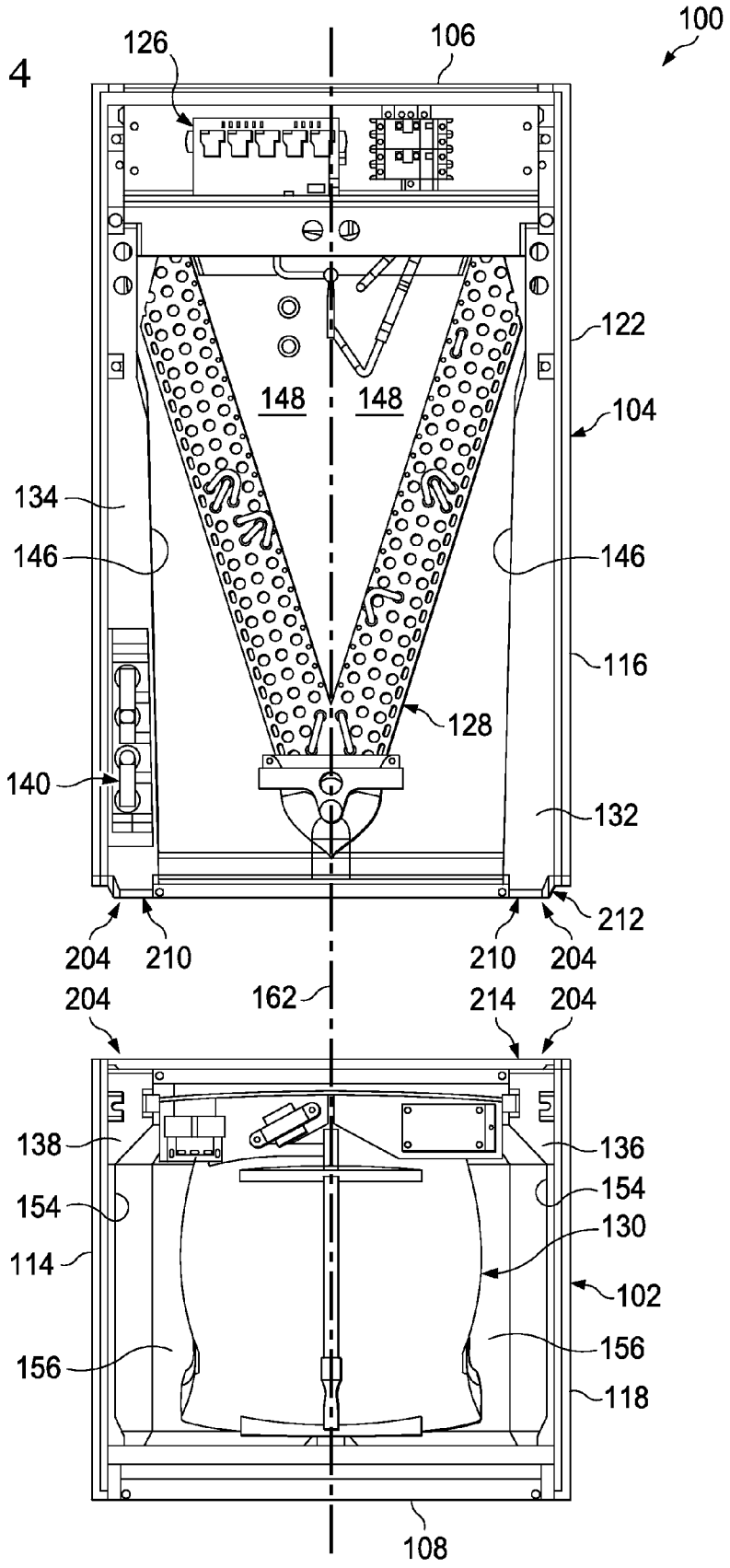
FIG. 4 is an orthogonal view of the front of the air handling unit of FIG. 1 in an unassembled configuration.
Figure 5:
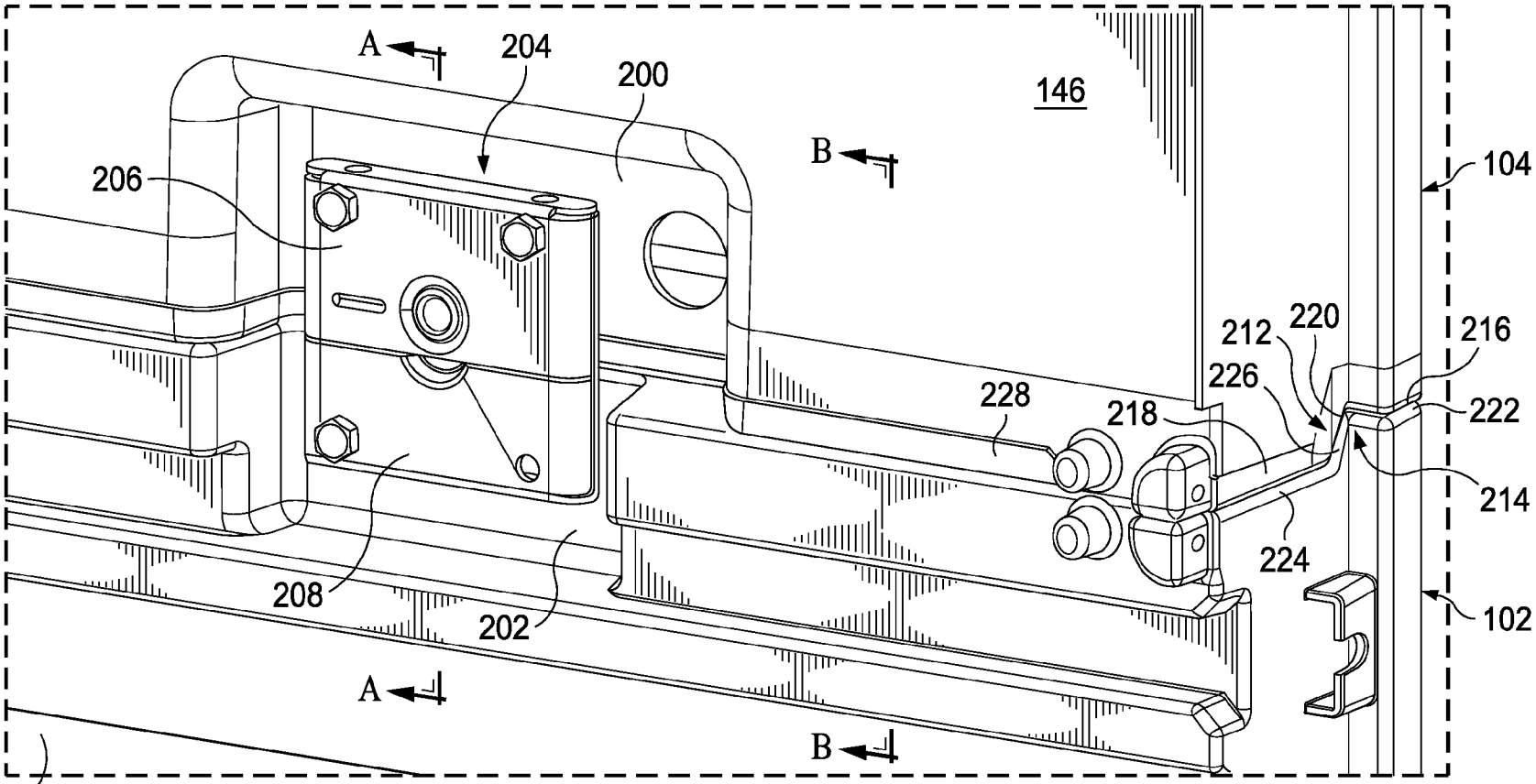
FIG. 5 is an oblique left side view of a connector system joining a heat exchanger cabinet right shell of the air handling unit of FIG. 1 to a blower cabinet right shell of the air handling unit of FIG. 1.
Figure 6:
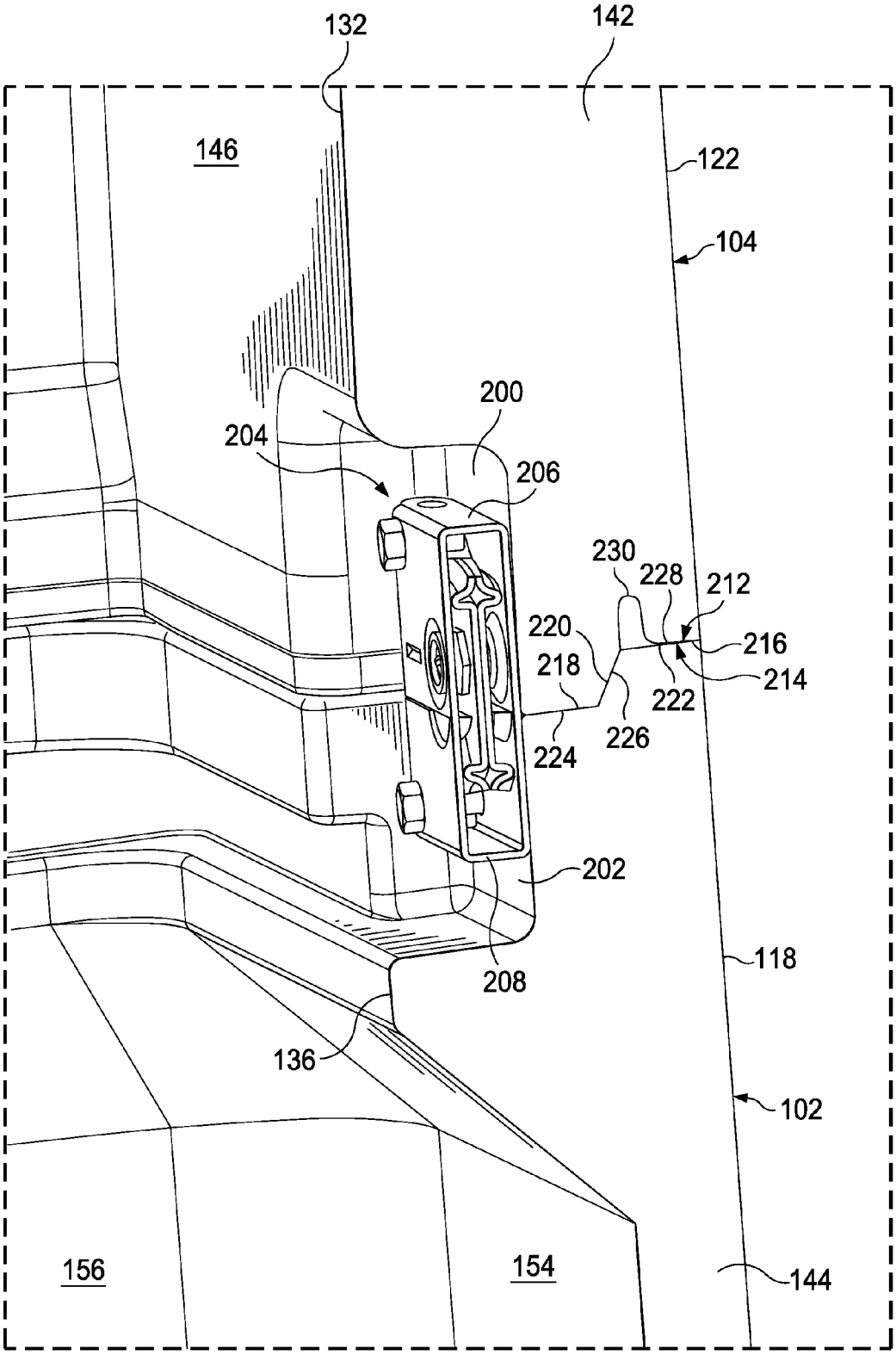
FIG. 6 is an oblique cut-away left side view of a connector system joining a heat exchanger cabinet right shell of the air handling unit of FIG. 1 to a blower cabinet right shell of the air handling unit of FIG. 1, the cut being made along cutting plane A-A of FIG. 5.

The AHU 100 may be referred to as being in an assembled state when the blower cabinet 102 is joined to the heat exchanger cabinet 104 in the manner shown in FIGS. 1 and 2. However, referring now to FIG. 4, the AHU 100 may selectively be transitioned into an unassembled state by removing the blower cabinet 102 from the heat exchanger cabinet 104. There are many reasons for which such disconnection may be useful. For example, during installation of an AHU 100, it may be necessary to pass the AHU 100 through a small access opening, such as an attic entrance. In such cases, an AHU 100 in the assembled state shown in FIGS. 1 and 2 may be too large to fit through the small access opening. Accordingly, such selective separation of the blower cabinet 102 from the heat exchanger cabinet 104 may be useful because such separation may allow passage of the blower cabinet 102 and the heat exchanger cabinet 104 to individually be passed through the small access opening. After such passage of the blower cabinet 102 and the heat exchanger cabinet 104 through the small access opening, the blower cabinet 102 and the heat exchanger cabinet 104 may again be joined together to return the AHU 100 to the assembled state. It will be appreciated that the ease with which the selective assembly and disassembly of the AHU 100 occurs may depend on the ease with which the blower cabinet 102 and the heat exchanger cabinet 104 may be brought into proper alignment with each other (or removed from such alignment) and the ease with which the blower cabinet 102 and the heat exchanger cabinet 104 may be secured together (or released from such securing).

In conventional AHUs, the reassembly of various cabinets of the AHU may also present problems of incorrect reassembly and the need to very carefully align the multiple cabinets. For example, in some conventional AHUs, one or more cabinets may be installed in a backward airflow arrangement which may lead to improper operation. Further, during attachment of cabinets alignment may not only include moving the cabinets closer to each other but also very carefully aligning the cabinets in forward-backward directions and in right-left directions. The present disclosure comprises features that alleviate such concerns of improper installation orientation and fine alignment during connection of cabinets.

Referring now to FIGS. 3-7, one or more of the heat exchanger cabinet right shell 132 and the heat exchanger cabinet left shell 134 may comprise integral assembly recesses 200. Assembly recesses 200 may be located near a lower end of the heat exchanger cabinet right shell 132 and the heat exchanger cabinet left shell 134. Assembly recesses 200 may accept mounting hardware therein for joining the heat exchanger cabinet 104 to the blower cabinet 102. In this embodiment, the recesses 200 are substantially shaped as box shaped recesses, however, in alternative embodiments, the recesses 200 may be shaped any other suitable manner. Similarly, one or more of the blower cabinet right shell 136 and the blower cabinet left shell 138 may comprise integral assembly recesses 202. Assembly recesses 202 may be located near an upper end of the blower cabinet right shell 136 and the blower cabinet left shell 138. Assembly recesses 202 may accept mounting hardware therein for joining the blower cabinet 102 to the heat exchanger cabinet 104. In this embodiment, the recesses 202 are substantially shaped as box shaped recesses, however, in alternative embodiments, the recesses 240 may be shaped any other suitable manner.

In this embodiment, the AHU 100 comprises connector systems 204, each comprising a latch housing 206 and a receiver housing 208. A latch 210 carried by the latch housing 206 may be rotated to selectively engage and disengage the receiver housing 208. However, it will be appreciated that any other suitable connection device may be used such as draw latches or other quick-connect components. In this embodiment, latch housings 206 are secured to the heat exchanger cabinet 104 within the assembly recesses 200 while the complementary receiver housings 208 are secured to the blower cabinet 102 within the assembly recesses 202. Accordingly, in this embodiment, to access the connector system 204, the heat exchanger cabinet panel 124 may be removed. With the panel 124 removed, the connector systems 204 may be accessed actuated to either secure the blower cabinet 102 to the heat exchanger cabinet 104 or to release the blower cabinet 102 from the heat exchanger cabinet 104.

The connector systems 204, in this embodiment, are configured to provide a latch connection between adjacent cabinets 102, 104 through the use of a cam-like action in response to rotation of the latch 210 by less than 360°. More specifically, as the latch 210 is received within the receiver housing 208, the connector system 204 may provide a gradually increasing retaining force for securing the cabinets 102, 104. Further, rotation of the latch 210 does not significantly advance the latch 210 in a left-right direction. In this embodiment, the connector system 204 does not depend primarily on a screw-type action for selectively securing the cabinets 102, 104. In this embodiment, when the latch 210 is rotated within the latch housing 206 about an axis of rotation, the latch 210 is not substantially moved along the length of the axis of rotation. However, in alternative embodiments, connector systems 204 may be configured to comprise a screw-type action that assists in selectively securing the cabinets 102, 104. Further, while this embodiment shows the use of only two connector systems 204 for joining cabinets 102, 104, alternative embodiments may comprise fewer or more connection systems 204. Further, while this embodiment discloses connection systems being associated with the left and right sides of the AHU 100, generally, alternative embodiments may comprise one or more connection systems 204 associated with any other side of the AHU. Still further, in alternative embodiments, connections systems 204 may be received within recesses formed on exterior portions of the AHU 100. Accordingly, this disclosure contemplates the use of any number of suitable connections systems 204 in association with any suitable side of an AHU 100 and in association with any suitable recess of an AHU 100. It is contemplated that any of the above-described embodiments may offer relatively quick and easy connection and disconnection of adjacent AHU 100 cabinets (such as cabinets 102, 104). Still further, any of the above embodiments may further be used in combination with standard connection systems and methods while still offering improved cabinet connection and disconnection functionality. For example, connection systems 204 and/or other features disclosed herein may be used to provide an initial connection between cabinets while other conventional connection systems and methods may be used to further connect adjacent cabinets.

Figure 7:
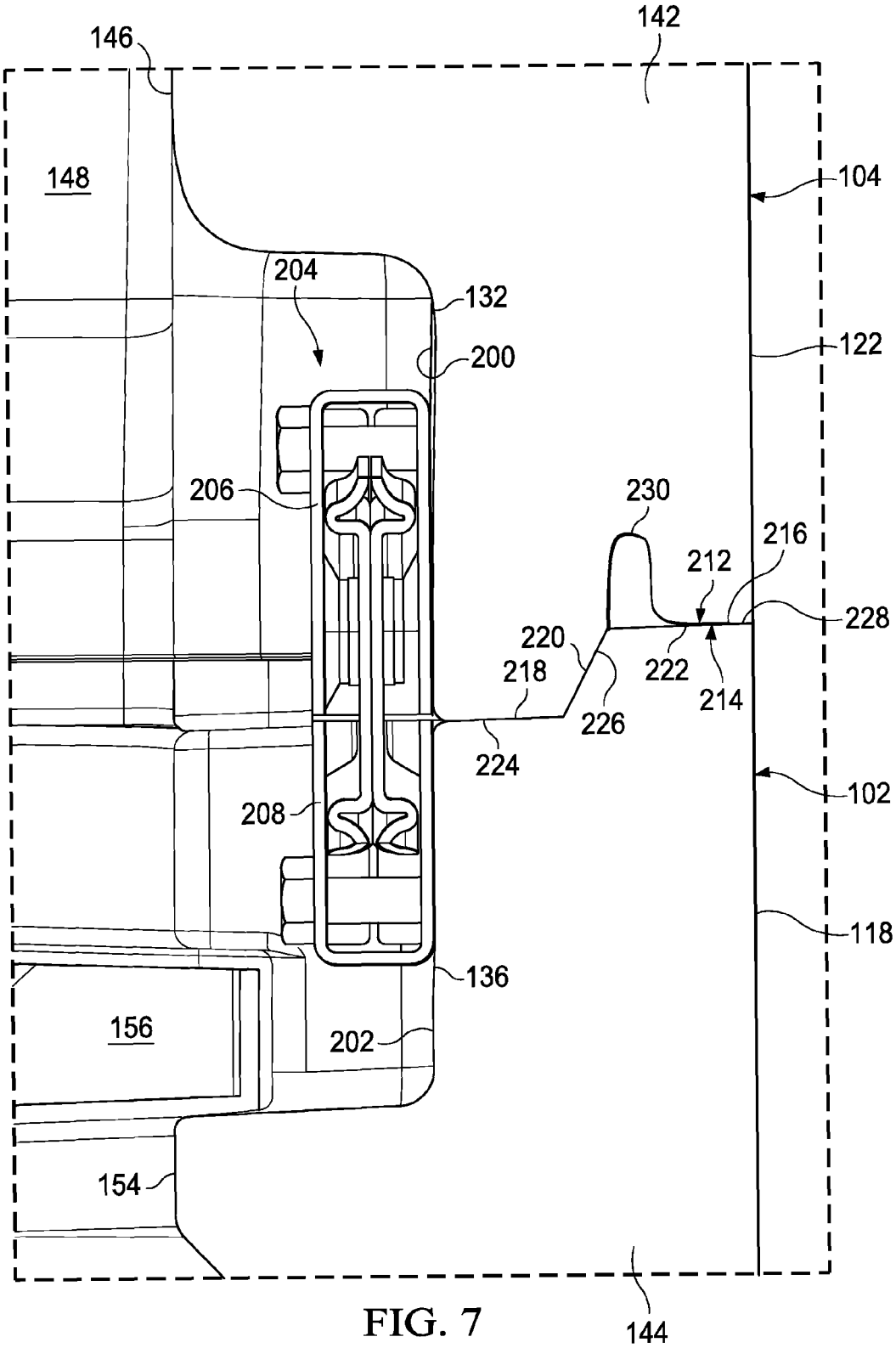
FIG. 7 is an orthogonal cut-away view of a connector system joining a heat exchanger cabinet right shell of the air handling unit of FIG. 1 to a blower cabinet right shell of the air handling unit of FIG. 1, the cut being made along cutting plane A-A of FIG. 5.
Figure 8:
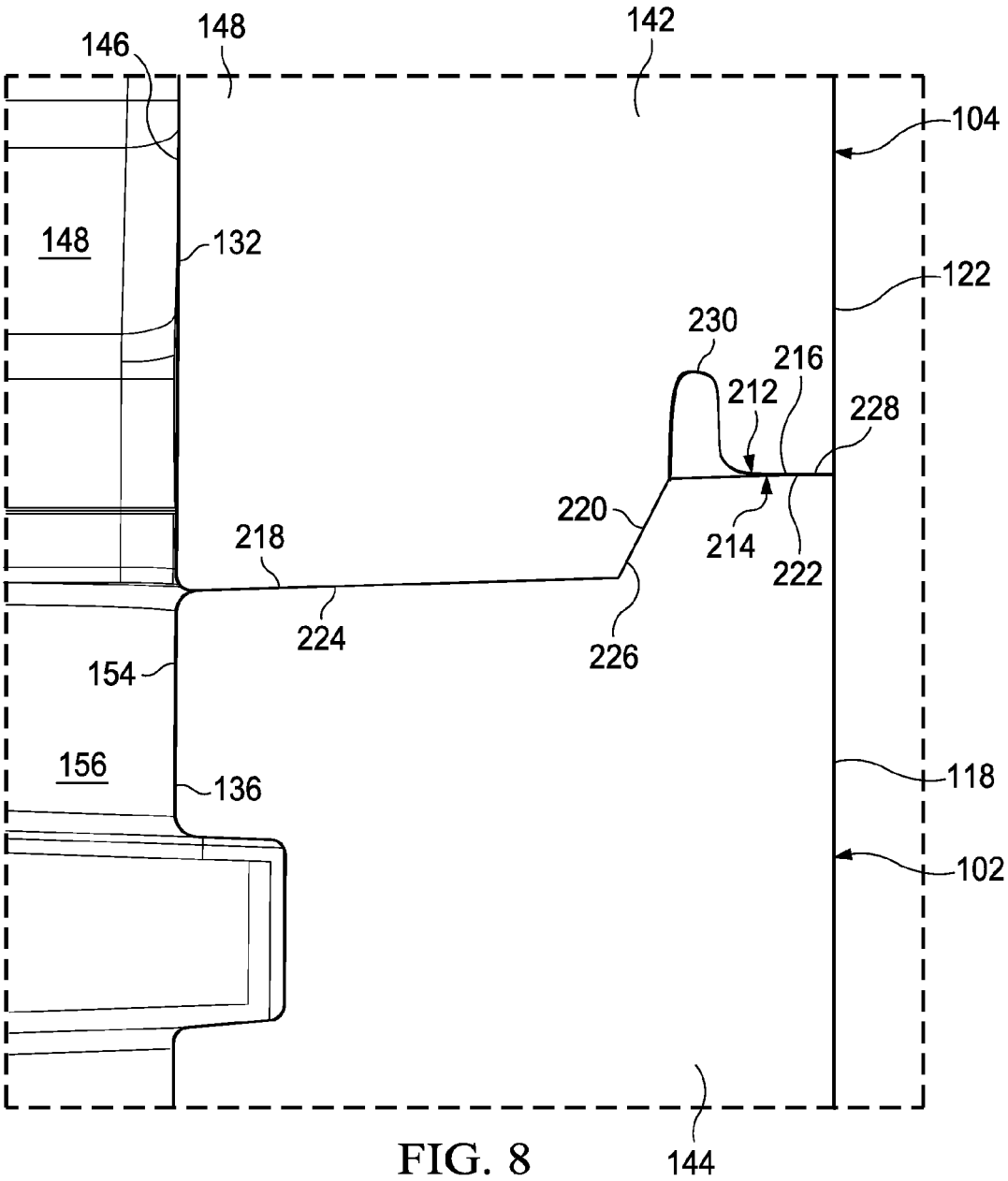
FIG. 8 is an orthogonal cut-away view of a heat exchanger cabinet right shell of the air handling unit of FIG. 1 that is connected to a blower cabinet right shell of the air handling unit of FIG. 1, the cut being made along cutting plane B-B of FIG. 5.

Referring now to FIGS. 5-8, the geometry of the mating portions of the blower cabinet 102 and the heat exchanger cabinet 104 may provide improved alignment when joining the blower cabinet 102 to the heat exchanger cabinet 104. In this embodiment, the AHU 100 may be described as comprising complementary interfaces which together comprise an alignment feature. More specifically, in this embodiment, the lower end of the heat exchanger cabinet 104 comprises a male profile 212 while upper end of the blower cabinet 102 comprises a complementary female profile 214. The male profile 212 comprises an outer ledge 216 joined to a lower and substantially parallel inner ledge 218 by a sloped wall 220. The female profile 214 comprises an outer ledge 222 joined to a lower and substantially parallel inner ledge 224 by a sloped wall 226. During the joining of the blower cabinet 102 to the heat exchanger cabinet 104, the sloped walls 220, 226 may guide the male profile 212 into proper alignment with the female profile 214 in response to moving the blower cabinet 102 closer to the heat exchanger cabinet 104. When the male profile 212 is properly aligned with the female profile 214 and the blower cabinet 102 is abutted against the heat exchanger cabinet 104, the outer ledges 216, 222 abut each other, the sloped walls 220, 226 abut each other, and the inner ledges 218, 224 abut each other. In some embodiments, the male profile 212 may be formed by a tray 228 to which the heat exchanger cabinet right shell 132, the heat exchanger cabinet left shell 134, and the heat exchanger cabinet outer skin 122 may be joined. Of course, in alternative embodiments, the male profile 212 and the female profile 214 may be formed of different components of the AHU 100. Still further, in alternative embodiments, the general shape and composition of the male profile 212 and the female profile 214 may be different while still providing improved alignment. By comparing FIG. 7 and FIG. 8, it can be seen that the length of the inner ledges 218, 224 (in a left-right direction) may vary. FIG. 7 shows a cut-away view taken at cutting plane A-A of FIG. 5 while FIG. 8 shows a cut-away view taken at cutting plane B-B of FIG. 5. The inner ledges 218, 224 are shorter in locations associated with the recesses 200, 202. In this embodiment, the geometry of the male profile 212 and the female profile 214 provide a longer thermal path from the interior of the AHU 100 to the exterior of the AHU 100, in some cooling applications reducing the likelihood of condensation forming on the exterior of the AHU 100. For example, a length of a thermal path may, in some embodiments, be generally defined as a distance along an interface between a male profile 212 and female profile 214 that joins an inner portion of the interface to an exterior of the interface. Further, in cases where the AHU 100 is hung and/or suspended so that the AHU left side 114 or the AHU right side is the lowermost side, the overlapping nature of the male profile 212 when abutted to the female profile 214 may assist in lengthwise (top side 106 to bottom side 108) stiffness of the AHU 100. It will be appreciated that a seal, such as a flexible gasket, may be inserted in the joint between modules of the AHU 100 to prevent air leakage to and/or from the air handler between adjacent modules of the AHU 100. For example, a gasket may be received within a gasket recess such as gasket recess 230 to provide a seal between the male profile 212 and the female profile 214.

Figure 9:
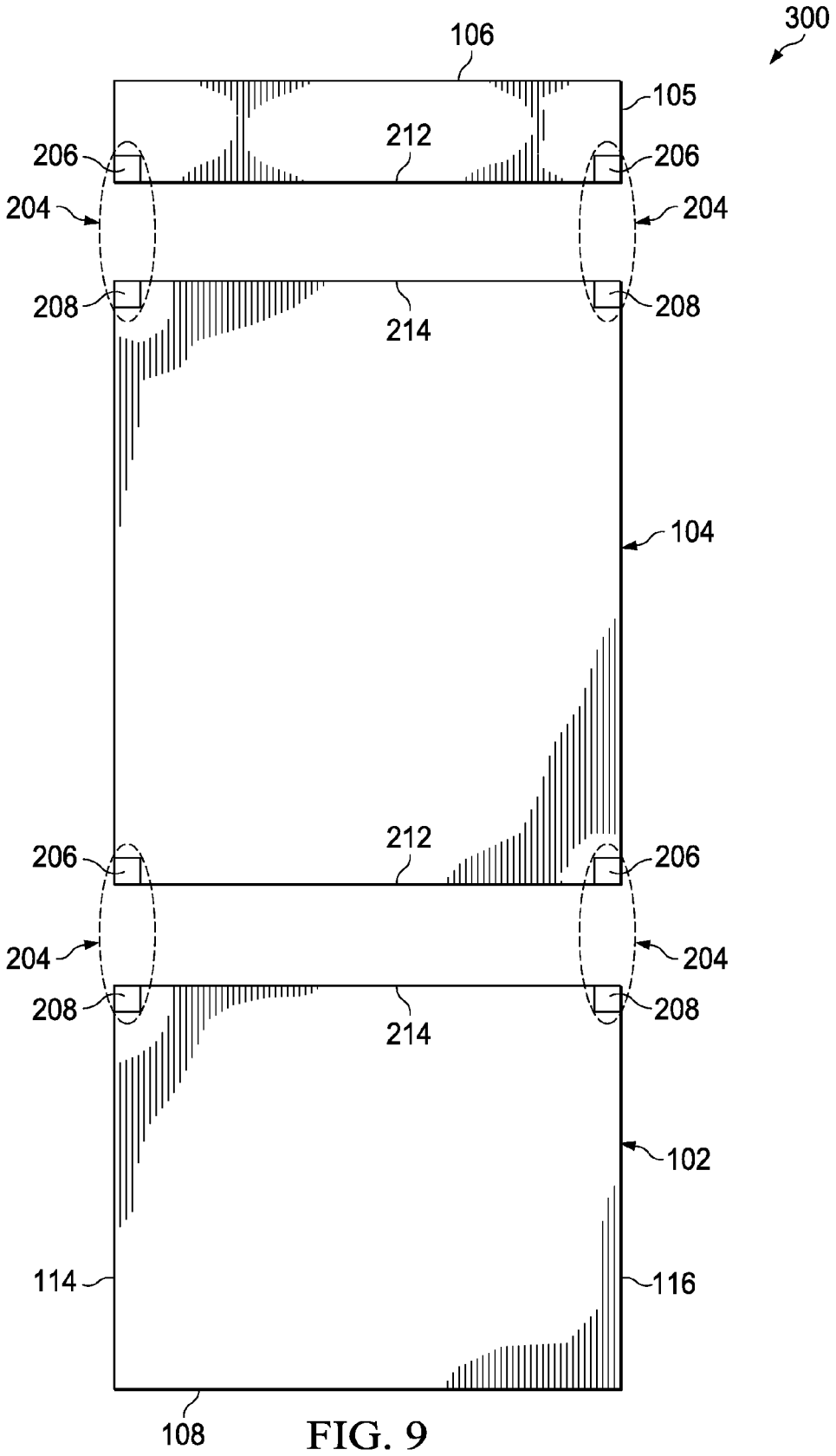
FIG. 9 is a simplified schematic view of another embodiments of an air handling unit in an unassembled configuration.

Referring now to FIG. 9, a simplified representation of an alternative AHU 300 embodiment is shown in an unassembled state. In this embodiment, AHU 300 is substantially similar to AHU 100 but further comprises additional connector systems 204, an additional male profile 212, and an additional female profile 214. Specifically, using the systems and methods disclosed above, the AHU 300 of FIG. 9 is configured so that a heater cabinet 105 that houses the heater assembly 126 is removable from the heat exchanger cabinet 104 in a manner substantially similar to the manner in which the heat exchanger cabinet 104 is separable from the blower cabinet 102.

Figure 10:
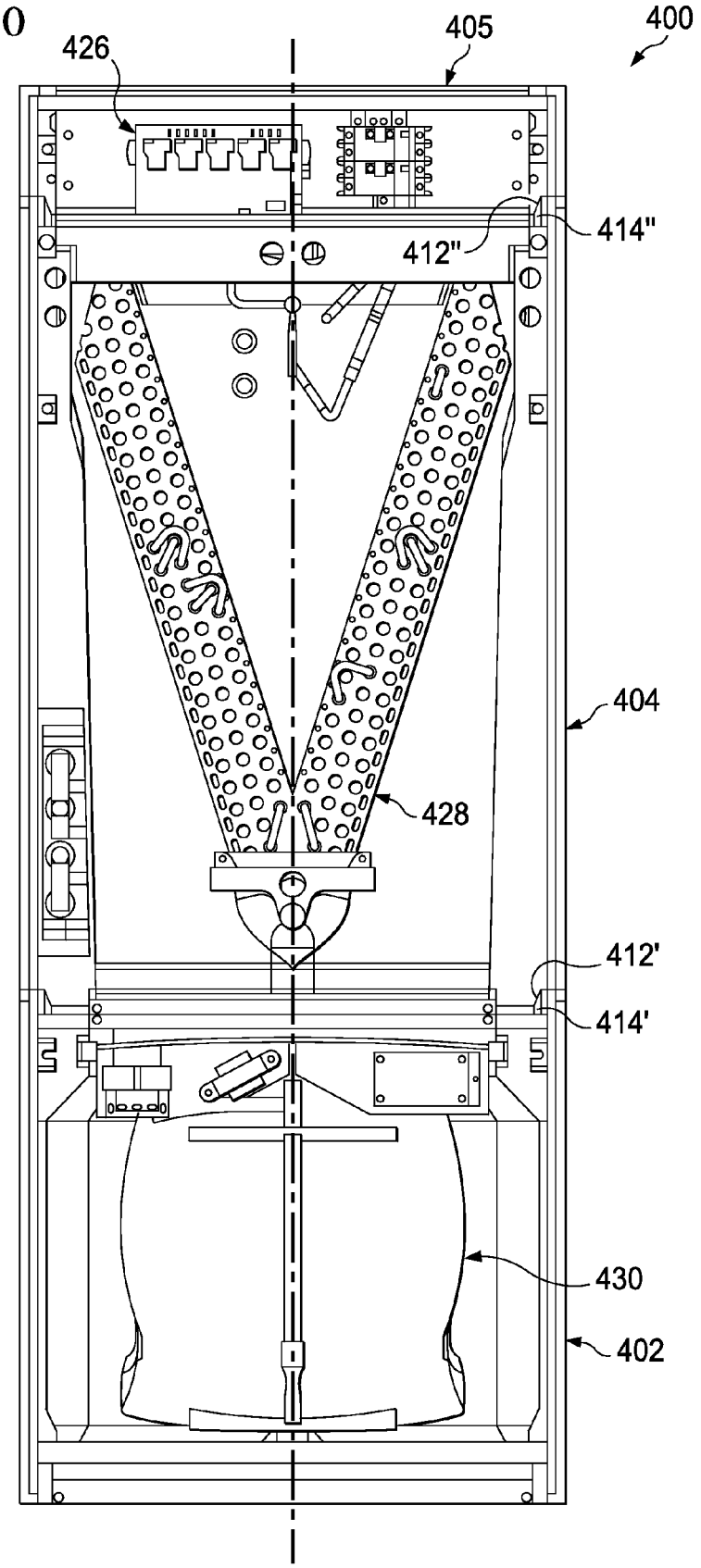
FIG. 10 is an orthogonal view of the front of an air handling unit in an assembled configuration according to an embodiment of the disclosure.

Referring now to FIG. 10, an orthogonal view of the front of an air handling unit 400 in an assembled configuration is shown according to an embodiment of the disclosure. AHU 400 may generally be substantially similar to AHU 100 in FIG. 1 in that AHU 400 comprises a blower cabinet 402 that houses a blower assembly 430 and comprises a female profile 414', a heat exchanger cabinet 404 that houses a refrigeration coil 428 and comprises a male profile 412', and a heater assembly 426. AHU 400 may also be substantially similar to AHU 300 in FIG. 9 in that AHU 400 comprises a heater cabinet 405 that houses the heater assembly 426, an additional male profile 412", and an additional female profile 414". In some embodiments, the heater cabinet 405 may generally comprise the additional male profile 412", while the heat exchanger cabinet 404 comprises the additional female profile 414" that may be substantially complimentary to the additional male profile 412". Using the systems and methods disclosed above, the heater cabinet 405 is generally removable from the heat exchanger cabinet 404 in a manner substantially similar to the manner in which the heat exchanger cabinet 104 is separable from the blower cabinet 102 in FIG. 1 and in which the heater cabinet 105 is removable from the heat exchanger cabinet 104 in FIG. 9.

In the embodiments disclosed above, the blower cabinet 102, the heat exchanger cabinet 104, and the heater cabinet 105 may be generally referred to as modules. Accordingly, the AHUs 100, 300 may be referred to as modular AHUs. It will be appreciated that the modular nature of the AHUs 100, 300 may not only lessen the difficulty of installing an AHU 100, 300, but may also improve the ease with which components of the AHUs 100, 300 may be repaired or replaced. For example, if a blower assembly 130 fails and must be replaced, in some embodiments, an entire blower cabinet 102 containing the failed blower assembly 130 may be removed and replaced using the connector systems 204. The modular nature of the AHUs 100, 300 may also be useful in providing convenient after sale add-on functionality. For example, if an AHU 300 is sold and/or installed without a heater cabinet 105 and associated heater assembly 126, a heater cabinet 105 with a heater assembly 126 may easily be added to the AHU 300 after such sale or installation.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising:

a first modular cabinet comprising a first profile; and a second modular cabinet comprising a second profile that is complementary to the first profile;

wherein the first profile comprises a first sloped surface disposed between a first inner wall of the first modular cabinet and a first outer wall of the first modular cabinet;

wherein the second profile comprises a second sloped surface disposed between a second inner wall of the second modular cabinet and a second outer wall of the second modular cabinet;

wherein the first sloped surface is fixed with respect to the first inner wall and the first outer wall and is oriented at a first sloped angle with respect to the first inner wall;

wherein the second sloped surface is fixed with respect to the second inner wall and the second outer wall and is oriented at a second sloped angle with respect to the second outer wall;

wherein the first sloped angle is substantially similar to the second sloped angle;

wherein the first profile and the second profile are configured to allow at least one of (1) a forward-backward misalignment and (2) a right-left misalignment of the first modular cabinet relative to the second modular cabinet when the first profile and the second profile at least partially longitudinally overlap; and wherein when the first profile at least partially overlaps the second profile in response to moving the first modular cabinet longitudinally towards the second modular cabinet, the second sloped surface is configured to interact with the first sloped surface by contacting the first sloped surface to properly align the first modular cabinet with the second modular cabinet such that the first sloped surface mates with the second sloped surface when the first modular cabinet and the second modular cabinet are properly aligned.

2. The air handling unit of claim 1, wherein the first sloped surface joins an inner ledge of the first profile to an outer ledge of the first profile.

3. The air handling unit of claim 2, wherein a length of the inner ledge varies along the depth of the first profile.

4. The air handling unit of claim 1, further comprising:

a connector system configured to releasably secure the first modular cabinet to the second modular cabinet.

5. The air handling unit of claim 4, wherein the connector system comprises a latch housing and a receiver housing and wherein the latch housing is carried by the first modular cabinet and the receiver housing is carried by the second modular cabinet.

6. The air handling unit of claim 5, wherein the connector system is accessible from an interior of the air handling unit.

7. The air handling unit of claim 1, wherein the first profile comprises a male profile and the second profile comprises a female profile.

8. The air handling unit of claim 1, wherein the first sloped surface is integrally formed with the first modular cabinet, and wherein the second sloped surface is integrally formed with the second modular cabinet.

9. An air handling unit, comprising:

a heat exchanger cabinet comprising a first profile;

a blower cabinet comprising a second profile complementary to the first profile; and a first connector system disposed at least partially on each of the heat exchanger cabinet and the blower cabinet;

wherein the first connector system is operable to releasably secure the first profile to the second profile;

wherein the first profile comprises a first sloped surface disposed between a first inner wall of the heat exchanger cabinet and a first outer wall of the heat exchanger cabinet;

wherein the second profile comprises a second sloped surface disposed between a second inner wall of the blower cabinet and a second outer wall of the blower cabinet;

wherein the first sloped surface is fixed with respect to the first inner wall and the first outer wall and is oriented at a first sloped angle with respect to the first inner wall;

wherein the second sloped surface is fixed with respect to the second inner wall and the second outer wall and is oriented at a second sloped angle with respect to the second outer wall;

wherein the first sloped angle is substantially similar to the second sloped angle;

wherein the first profile and the second profile are configured to allow at least one of (1) a forward-backward misalignment and (2) a right-left misalignment of the heat exchanger cabinet relative to the blower cabinet when the first profile and the second profile at least partially longitudinally overlap; and wherein when the first profile at least partially overlaps the second profile in response to moving the heat exchanger cabinet longitudinally towards the blower cabinet, the second sloped surface is configured to interact with the first sloped surface by contacting the first sloped surface to properly align the heat exchanger cabinet with the blower cabinet such that the first sloped surface mates with the second sloped surface when the heat exchanger cabinet and the blower cabinet are properly aligned.

10. The air handling unit according to claim 9, wherein at least one of the blower cabinet and the heat exchanger cabinet comprise a double-wall construction.

11. The air handling unit according to claim 10, wherein at least one of the blower cabinet and the heat exchanger cabinet comprises an interior assembly recess for receiving at least a portion of the first connector system.

12. The air handling unit according to claim 11, wherein the first connector system comprises a rotatable latch.

13. The air handling unit according to claim 12, wherein the first profile comprises a first male profile and the second profile comprises a first female profile and further comprising:

a heater cabinet comprising a second male profile;

wherein the heat exchanger cabinet further comprises a second female profile complementary to the second male profile.

14. The air handling unit according to claim 13, wherein the first profile is substantially similar to the second male profile and wherein the second profile is substantially similar to the second female profile.

15. The air handling unit according to claim 14, wherein a second connector system is at least partially carried by the heater cabinet and the heat exchanger cabinet and wherein the second connector system is operable to releasably secure the second male profile to the second female profile.

16. An air handling unit, comprising:

a first modular cabinet comprising a first portion of a first connection system and a first profile comprising a first sloped surface disposed between a first inner wall of the first modular cabinet and a first outer wall of the first modular cabinet; and a second modular cabinet comprising a second portion of the first connection system and a second profile comprising a second sloped surface disposed between a second inner wall of the second modular cabinet and a second outer wall of the second modular cabinet;

wherein the first sloped surface is fixed with respect to the first inner wall and the first outer wall and is oriented at a first sloped angle with respect to the first inner wall;

wherein the second sloped surface is fixed with respect to the second inner wall and the second outer wall and is oriented at a second sloped angle with respect to the second outer wall;

wherein the first sloped angle is substantially similar to the second sloped angle;

wherein the first profile and the second profile are configured to allow at least one of (1) a forward-backward misalignment and (2) a right-left misalignment of the first modular cabinet relative to the second modular cabinet when the first profile and the second profile at least partially longitudinally overlap;

wherein when the first profile at least partially overlaps the second profile in response to moving the first modular cabinet longitudinally towards the second modular cabinet, the second sloped surface is configured to interact with the first sloped surface by contacting the first sloped surface to properly align the first modular cabinet with the second modular cabinet such that the first sloped surface mates with the second sloped surface when the first modular cabinet and the second modular cabinet are properly aligned; and wherein the first connection system is configured to selectively secure the first modular cabinet to the second modular cabinet in response to a component of the first portion being at least partially received within the second portion.

17. The air handling unit according to claim 16, wherein the component is a latch.

18. The air handling unit according to claim 16, wherein the component is configured to be at least partially received within the second portion in response to rotation of the component by less than about 360°.

19. The air handling unit according to claim 16, wherein when the component is rotated within the first portion about an axis of rotation, the component is not substantially moved along the length of the axis of rotation.

20. The air handling unit according to claim 16, wherein the connection system is configured to provide an increasing force for securing the first modular cabinet to the second modular cabinet.

* * * * *